US006896498B1

(12) United States Patent
Patel

(10) Patent No.: US 6,896,498 B1
(45) Date of Patent: May 24, 2005

(54) SCROLL COMPRESSOR WITH HOT OIL TEMPERATURE RESPONSIVE RELIEF OF BACK PRESSURE CHAMBER

(75) Inventor: Tapesh P. Patel, Hot Springs, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/819,421

(22) Filed: Apr. 7, 2004

(51) Int. Cl.[7] ..... F01C 1/02; F04C 18/00

(52) U.S. Cl. ..... 418/55.5; 418/57; 418/55.4; 418/94

(58) Field of Search ..... 418/55.5, 51, 55.4, 418/57, 94, 98

(56) References Cited

U.S. PATENT DOCUMENTS 4,596,520 A * 6/1986 Arata et al. ..... 418/55.5
6,077,057 A * 6/2000 Hugenroth et al. ..... 418/55.5
6,217,302 B1 * 4/2001 Sun et al. ..... 418/55.5
6,554,592 B1 * 4/2003 Sun et al. ..... 418/55.5

FOREIGN PATENT DOCUMENTS

JP 01012091 A * 1/1989
JP 05187370 A * 7/1993

* cited by examiner

*Primary Examiner*—Theresa Trieu
(74) *Attorney, Agent, or Firm*—Carlson, Gaskey & Olds

(57) ABSTRACT

A scroll compressor includes a protection device that has a valve movable between a position blocking flow from the back pressure chamber into the suction chamber, and a position allowing such flow. The valve is movable dependent on an oil temperature. Under adverse conditions, the oil will reach higher temperatures and the valve will open allowing flow of refrigerant from the back pressure chamber into the suction chamber. This refrigerant will likely be at an elevated temperature, and will assist the heated oil in moving a motor protection switch associated with the motor to shut down the motor. Moreover, by relieving the back pressure chamber, the two scroll members are allowed to move out of contact with each other, thereby reducing potential damage due to the adverse conditions.

10 Claims, 2 Drawing Sheets

SCROLL COMPRESSOR WITH HOT OIL TEMPERATURE RESPONSIVE RELIEF OF BACK PRESSURE CHAMBER

BACKGROUND OF THE INVENTION

This application relates to a scroll compressor having a protection device that releases the back pressure chamber refrigerant if an oil temperature reaches an undesirably high level. The present invention thus better addresses certain operational problems more quickly than the prior art.

Scroll compressors are becoming widely utilized in refrigerant compression applications. In a scroll compressor, a pair of scroll members each include a base and a generally spiral wrap extending from the bases. The wraps interfit to define compression chambers. One of the two scroll members is caused to orbit relative to the other, and as the two orbit, the size of the compression chambers is reduced, compressing an entrapped refrigerant. As the refrigerant pressure increases, a separating force from the refrigerant tends to force the two scroll members away from each other. Thus, scroll compressor designers tap a portion of a compressed refrigerant to a chamber behind the base of one of the two scroll members. This is called a "back pressure chamber" and serves to bias the two scroll members together, resisting the separating.

Various operational challenges exist with the scroll compressor. In particular, the complex surfaces between the two scroll members present a good deal of interfitting contact surfaces. Under certain conditions, there can be damage along the contact surfaces. As an example, if the motor for the scroll compressor is improperly wired, the compressor could run in a reverse direction. This will cause unduly high temperatures to quickly exist in the scroll compressor. This can lead to various damage to the compressor components. As an example, there can be galling of the base plates and the wraps.

Further, another problem can exist due to the cooling method utilized in most sealed compressors. In most sealed compressors, suction refrigerant is passed over the motor resulting in cooling of the motor. However, under certain conditions, the charge of refrigerant in the system may be unduly low. This is known as a loss of charge situation. When there is a low amount of suction refrigerant moving over the motor, the motor may not be adequately cooled.

Thus, there are protection devices for these adverse situations. In one traditional scheme, a motor protector is placed on the motor and includes a temperature sensor. The temperature sensor trips to open a circuit, and stop further operation of the motor should the temperature sensor sense an unduly high temperature. These basic motor protectors have been placed in various locations within the scroll compressor.

Another method that is utilized in combination with these motor protectors is to bring the heat from the scroll compressor pump unit, which will typically become hot more quickly than other areas in the scroll compressor under adverse conditions, to the motor protector. As an example, one prior art arrangement has a valve that opens when an unduly high temperature is sensed in the discharge refrigerant. The valve will pass refrigerant from the compression chambers down into the suction chamber that surrounds the motor and hence the protector. Another method passes hot oil onto the motor protector, again to trip the motor protector temperature sensor more quickly than if the motor protector temperature sensor simply was reacting to the temperature in the motor chamber.

While the above-described protection methods provide benefit, it would be desirable to have an initial protection occur before the extreme temperature that now results in the tripping of the motor. To date, the known scroll compressors have not adequately provided more prompt relief of the adverse conditions.

SUMMARY OF THE INVENTION

In the disclosed embodiment of this invention, hot oil is returned over a valve that sits in a passage communicating the back pressure chamber to the suction chamber surrounding the motor. Should the hot oil temperature reach an unduly hot temperature, the valve opens. With the valve open, the back pressure refrigerant passes through the passage, into the suction chamber, and onto the motor protector. This will more quickly trip the motor protector than is the case in the prior art.

Preferably, that same oil also drips onto the motor protector. In addition, by opening the back pressure chamber, the scroll members will be allowed to move away from each other, and will more readily resist the problems with galling, undue tip thrust, etc. mentioned above.

These and other features of the present invention can be best understood from the following specification and drawings, the following of which is a brief description.

DETAILED DESCRIPTION OF THE PREFERRED EMBODIMENT

Figure 1:
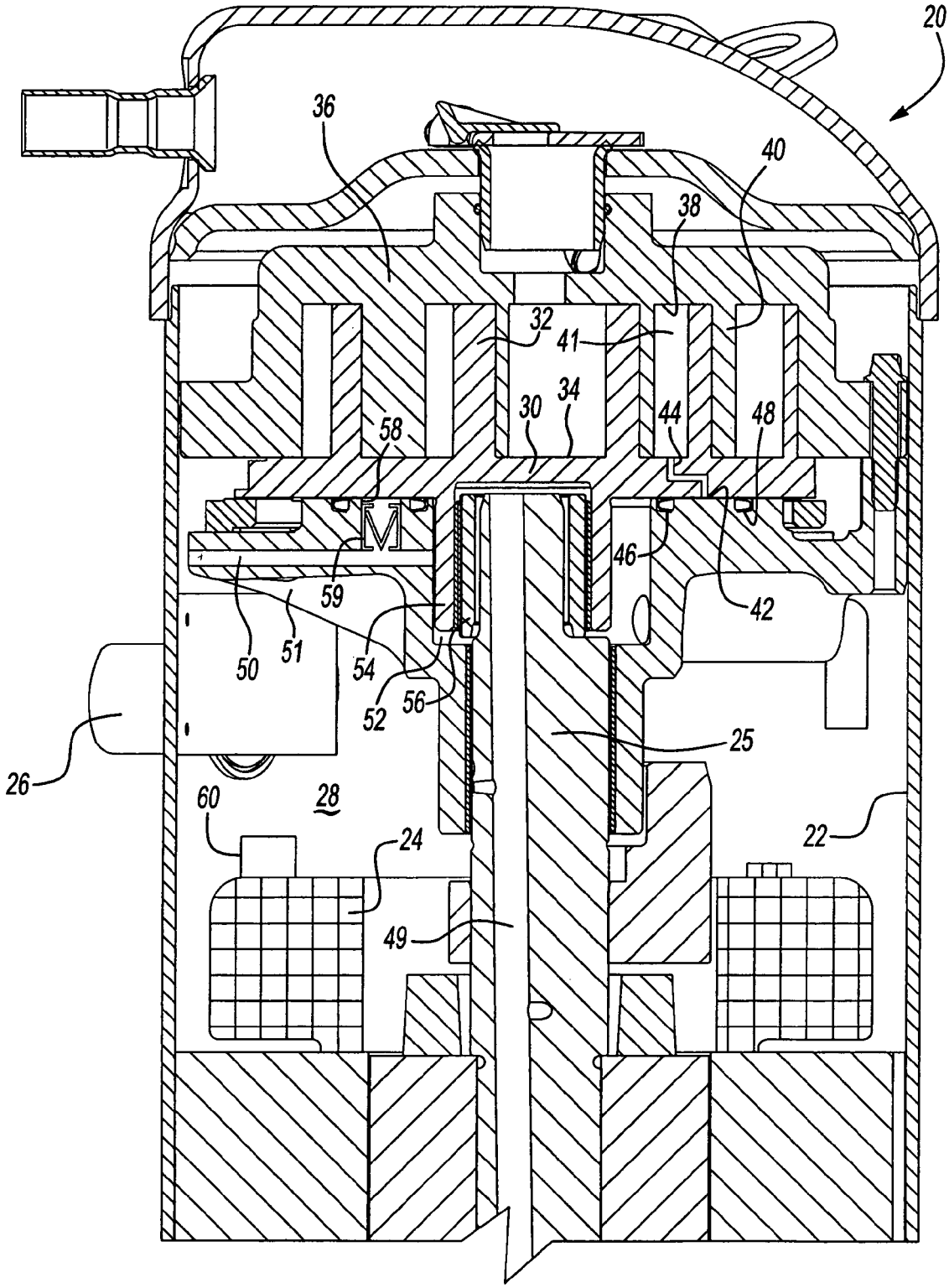
FIG. 1 shows a cross-sectional view of a scroll compressor incorporating the present invention.

A scroll compressor 20 is illustrated in FIG. 1. Scroll compressor 20 is housed within a sealed housing 22. As known, an electric motor 24 drives a shaft 25 to compress a refrigerant. The refrigerant enters the sealed housing 22 through a suction tube 26. A suction chamber 28 surrounds the motor, and a suction refrigerant can pass over the motor to cool the motor.

A first scroll member 30, known as an orbiting scroll, includes a spiral wrap 32 extending from a base 34. The illustrated scroll wrap is of a so-called "hybrid" style having varying thickness in its scroll wraps. Other types of scroll compressors would come within the scope of this invention, including a scroll wrap formed on an involute of a circle, which would have a relatively constant thickness to its wraps. The orbiting scroll 30 faces a non-orbiting scroll 36 having a base 38 in its own wrap 40 extending from the base. As shown, the wraps interfit to define compression chambers 41. The drive shaft 25 is driven to rotate, and a non-rotation coupling causes the orbiting scroll 30 to orbit relative to the non-orbiting scroll 36, as known.

Certain challenges are raised by the operation of such scroll compressors. In particular, it sometimes occurs that the motors are mis-wired, such that they are driven in a reverse direction. When this occurs, the temperature of the refrigerant can reach unduly high levels, and there can be damage to the scroll members. In particular, the surfaces between the tips and the opposed base can result in galling, unduly high tip pressure, etc. All of this would be undesirable from a base 34. The orbiting scroll 30 faces a non-orbiting scroll 36 having a base 38 in its own wrap 40 extending from the base. As shown, the wraps interfit to define compression chambers 41. The drive shaft 25 is driven to rotate, and a non-rotation coupling causes the orbiting scroll 30 to orbit relative to the non-orbiting scroll 36, as known.

Certain challenges are raised by the operation of such scroll compressors. In particular, it sometimes occurs that the motors are mis-wired, such that they are driven in a reverse direction. When this occurs, the temperature of the refrigerant can reach unduly high levels, and there can be damage to the scroll members. In particular, the contact at surfaces between the tips and the opposed base can result in galling, unduly high tip pressure, etc. All of this would be undesirable.

Another challenge is when there is an insufficient charge of refrigerant in the refrigerant cycle. In particular, the refrigerant leading into the suction chamber 28 must be of a sufficient volume to cool motor 24, or motor 24 can reach unduly high temperatures. When there is a loss of charge on the refrigerant line supplying the refrigerant to the suction tube 26, there may be insufficient refrigerant to adequately cool the motor.

As is known, a separating force is created in the compression chambers 41 tending to move the orbiting scroll 30 away from the non-orbiting scroll 36. Thus, to address this, a back pressure chamber 42 is provided behind the base of one of the scroll members. The back pressure chamber 42 is illustrated behind the base of the orbiting scroll 30, however, it should be understood that other scroll compressor designs incorporate a back pressure chamber behind the non-orbiting scroll, and would benefit from this invention also. An inner seal 46 and an outer seal 48 define the back pressure chamber 42. The compressed refrigerant from the compression chamber 41 passes through the tap 44 and into the back pressure chamber 42. This tapped compressed refrigerant forces the orbiting and non-orbiting scrolls together.

As shown in the figure, an oil supply line 49 supplies oil from a sump at the bottom of the housing 22 upwardly through the drive shaft 25. The oil is directed to various operational surfaces. Some of the oil is returned through an oil return line 50 extending through a crankcase 51. The oil from supply line 49 communicates with a bearing chamber 52 including a yoke 54 from the orbiting scroll, and a bearing 56, and to return line 50. From return line 50, the oil may flow onto motor protector 60. As can be appreciated, during the above-described adverse conditions, this oil will reach higher temperatures than would otherwise be expected.

A valve 59 is placed on a passage 58 leading to the back pressure chamber 42. The valve 59 is a thermal valve which, when exposed to unduly high temperatures, will open to dump the refrigerant from the back pressure chamber 42 into return line 50, and eventually to a motor protector 60. As known, the motor protector 60 includes a temperature-sensitive switch that opens to stop operation of the motor should unduly high temperatures be reached. By dumping the back pressure chamber from back pressure chamber 42 onto the motor protector 60, the present invention ensures that the shutting off of the motor occurs more quickly than if the hot oil were simply allowed to drip onto the motor protector 60.

Figure 2A:
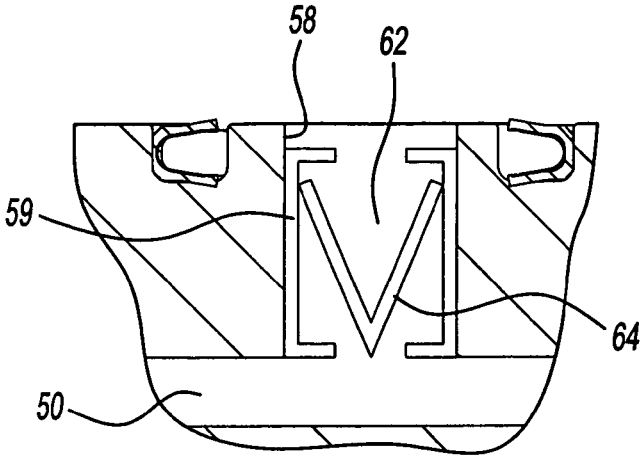
FIG. 2A shows the inventive valve in a normal operational position.

FIG. 2A shows the normal position of the valve 59 when the temperature in the oil return line 50 is not unduly high. A passage 62 extends through the valve 59. However, this passage is blocked by a bi-metal thermally responsive valve body 64. Such valves are known and move between two positions dependent on the temperature of the valve member. Notably, the construction of the illustrated valve is somewhat simplified to provide an understanding of its operation. The valve member is thus selected and designed to be in the position illustrated in FIG. 2A, blocking flow through the passage 62, unless a predetermined temperature is reached in the returned oil in the oil return line 50.

Figure 2B:
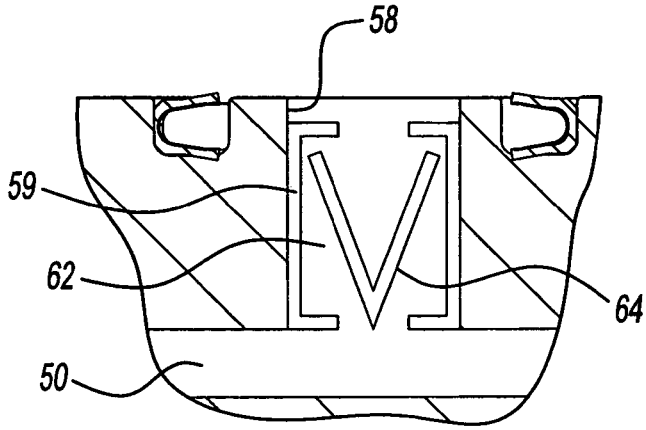
FIG. 2B shows an inventive valve in a release condition.

As shown in FIG. 2B, once this predetermined high temperature is reached, the valve element 64 snaps to its open position. Refrigerant can pass through the passage 62, and into the return oil line 50. This release of refrigerant accomplishes two functions. First, by releasing the back pressure chamber, the scroll members are allowed to move away from each other. Thus, some of the damage that occurs early under the influence of adverse conditions may be prevented. That is, the tips of the wraps will not be held in contact with the opposed bases of the two scroll members, and galling, etc. may be reduced or eliminated. Secondly, by moving the back pressure chamber refrigerant out of the back pressure chamber, into passage 50, and eventually into suction chamber 28, the higher temperatures will reach the temperature protection switch 60 more quickly. Thus, the operation of the motor 24 will be stopped more quickly than was the case in the prior art.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from said base, and a second scroll member having a base and a generally spiral wrap extending from its base, said wraps of said first and second scroll members interfitting to define compression chambers;

an electric motor driving a rotating shaft, said rotating shaft being connected to said first scroll member through a coupling to cause said first scroll member to orbit relative to said second scroll member and cause a reduction in size of said compression chambers, to thereby compress an entrapped refrigerant;

a back pressure chamber defined behind a base of one of said first and second scroll members, said back pressure chamber including a tap to tap refrigerant from a compression chamber to said back pressure chamber, and said tapped refrigerant causing said first and second scroll members to be biased together; and a valve operably associated with the back pressure chamber, oil for lubricating the scroll compressor, the valve positioned to be exposed to the oil, said valve being movable from an open position to a blocking position, said valve allowing flow of refrigerant from said back pressure chamber into a suction chamber surrounding said motor when in said open position, and said valve moving to said blocking position blocking flow of refrigerant from said back pressure chamber, said valve being movable between said open and blocking positions dependent upon the temperature of oil sensed by said valve.

2. The scroll compressor as recited in claim 1, wherein said valve is positioned in an oil return line such that a returned oil temperature moves said valve between said open and blocking positions.

3. The scroll compressor as recited in claim 2, wherein said valve includes a bi-metal valve element that is movable dependent on temperature between said open and blocking positions.

4. The scroll compressor as recited in claim 2, wherein said oil return line is positioned to return oil onto a motor protection switch associated with said motor.

5. The scroll compressor as recited in claim 2, wherein said valve is positioned in a passage communicating said back pressure chamber into said oil return line, and from said oil return line into said suction pressure chamber.

6. The scroll compressor as recited in claim 1, wherein said back pressure chamber is defined behind said base of said first scroll member.

7. A scroll compressor comprising:

a first scroll member having a base and a generally spiral wrap extending from said base, and a second scroll member having a base and a generally spiral wrap extending from its base, said wraps of said first and second scroll members interfitting to define compression chambers;

an electric motor driving a rotating shaft, said rotating shaft being connected to said first scroll member through a coupling to cause said first scroll member to orbit relative to said second scroll member and cause a reduction in size of said compression chambers, to thereby compress an entrapped refrigerant;

a back pressure chamber defined behind said base of said first scroll member, said back pressure chamber including a tap to tap refrigerant from a compression chamber to said back pressure chamber, and said tapped refrigerant causing said first and second scroll members to be biased together; and oil for lubricating the scroll compressor, an oil return line, and a valve positioned to be exposed to oil in said oil return line, said valve being movable from an open position to a blocking position, said valve allowing flow of refrigerant from said back pressure chamber into a suction chamber surrounding said motor when in said open position, and said valve moving to said blocking position blocking flow of refrigerant from said back pressure chamber, said valve being movable between said open and blocking positions dependent upon a temperature sensed by said valve.

8. The scroll compressor as recited in claim 7, wherein said valve includes a bi-metal valve element that is movable dependent on temperature between said open and blocking positions.

9. The scroll compressor as recited in claim 7, wherein said oil return line is positioned to return oil onto a motor protection switch associated with said motor.

10. The scroll compressor as recited in claim 7, wherein said valve is positioned in a passage communicating said back pressure chamber into said oil return line, and from said oil return line into said suction pressure chamber.

* * * * *